US005799921A

United States Patent [19]

Stattel

[11] Patent Number: 5,799,921

[45] Date of Patent: Sep. 1, 1998

[54] DEVICE FOR PREVENTING THE UNINTENTIONAL CONTACT BETWEEN FURNITURE AND A WALL

[76] Inventor: Gregory W. Stattel, 17 Falcon Ct., Farmingville, N.Y. 11738

[21] Appl. No.: 676,939

[22] Filed: Jul. 8, 1996

[51] Int. Cl.[6] ..... A47B 97/00

[52] U.S. Cl. ..... 248/501; 248/300; 248/345.1; 297/463.1; 297/463.2

[58] Field of Search ..... 297/463.1, 463.2; 248/300, 345.1, 501 OR, 615

[56] References Cited

U.S. PATENT DOCUMENTS

| | | | |
|---|---|---|---|
| 1,043,370 | 11/1912 | Stubbs | 248/345.1 |
| 1,158,350 | 10/1915 | White | 248/345.1 |
| 1,445,726 | 2/1923 | Soros | 248/345.1 |
| 1,798,901 | 3/1931 | Punt | 248/345.1 |
| 2,683,328 | 7/1954 | Thulin | 297/463.1 |
| 2,769,275 | 11/1956 | Lindgreen | 248/345.1 |
| 3,137,090 | 6/1964 | Stouth | 248/345.1 |
| 3,869,106 | 3/1975 | Gregov | 248/345.1 |
| 3,969,786 | 7/1976 | Peak . | |
| 4,161,853 | 7/1979 | Weiss et al. . | |
| 4,881,293 | 11/1989 | Reynolds . | |
| 5,611,094 | 3/1997 | D'Entremont | 248/345.1 |

*Primary Examiner*—Peter M. Cuomo
*Assistant Examiner*—Anthony D. Barfield
*Attorney, Agent, or Firm*—Richard L. Miller, P.E.

[57] ABSTRACT

A wall contacting prevention device being positionable on a floor with a finish and receiving right and left rear legs of a typical piece of furniture while maintaining the typical piece of furniture a predetermined distance from a wall that includes a right wall contacting prevention device and a left wall contacting prevention device. The right wall contacting prevention device has a longitudinal midpoint and is positionable on the floor, in abutment with the wall, and receives the right rear leg of the typical piece of furniture while maintaining the typical piece of furniture the predetermined distance from the wall. And, the left wall contacting prevention device has a longitudinal midpoint and is separate from the right wall contacting prevention device and positioned on the floor, in abutment with the wall, and receives the left rear leg of the typical piece of furniture while maintaining the typical piece of furniture the predetermined distance from the wall, so that heat from a baseboard heater, if present, radiates into a room as opposed to being absorbed by the typical piece of furniture, unintentional contact between the typical piece of furniture and the wall is prevented while maintaining fire safety, finished walls are protected from being damaged by contact with the typical piece of furniture, the typical piece of furniture is prevented from damage caused by contact with the wall, and unwanted moving-of the typical piece of furniture is prevented and thereby prolonging the life thereof.

17 Claims, 1 Drawing Sheet

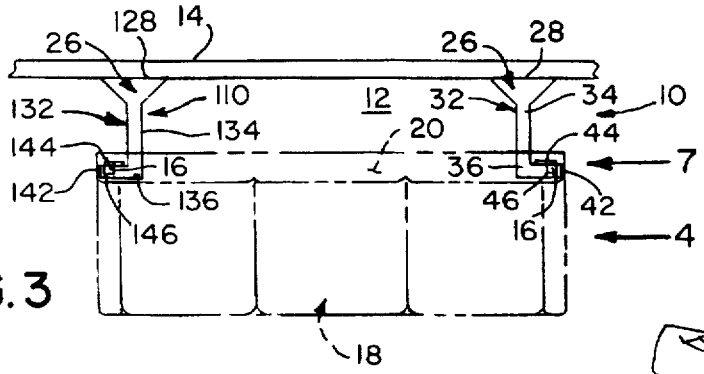
FIG. 3
FIG. 4
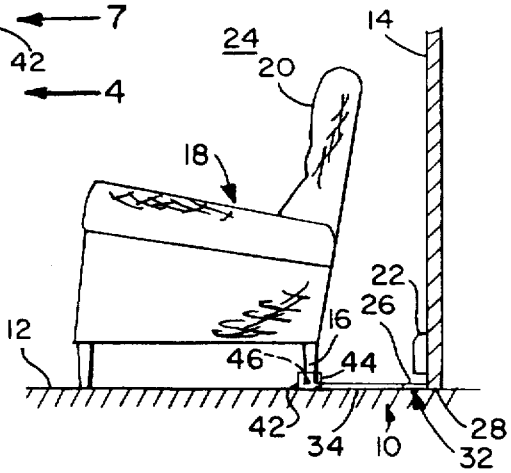
FIG. 1
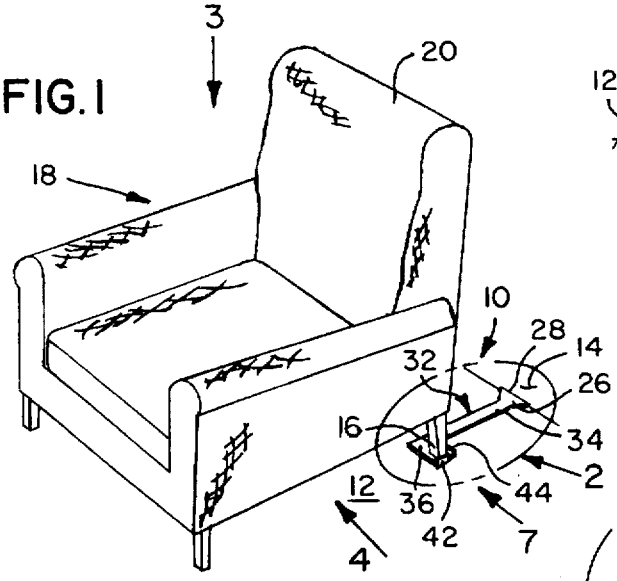
FIG. 2
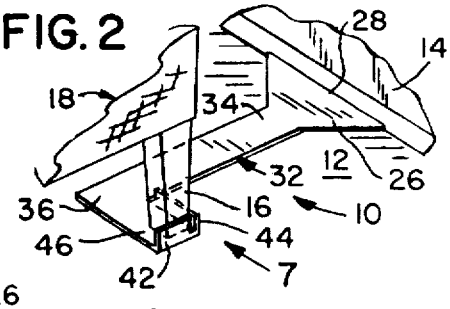
FIG. 7
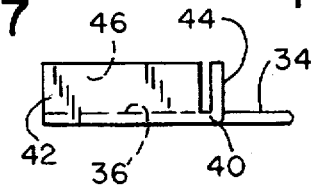
FIG. 6
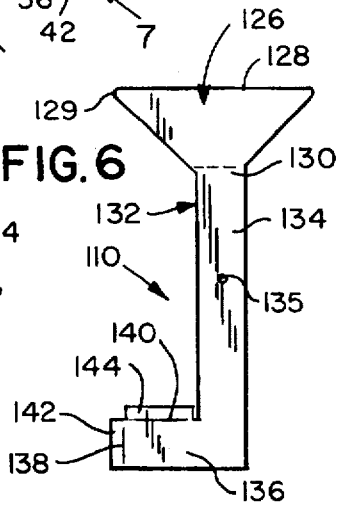
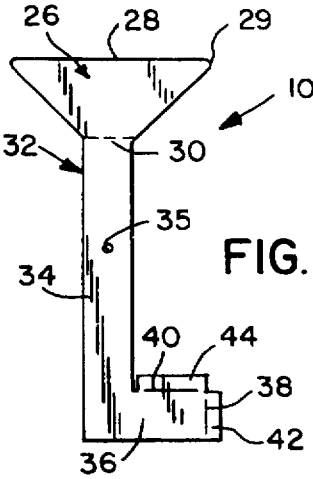
FIG. 5

DEVICE FOR PREVENTING THE UNINTENTIONAL CONTACT BETWEEN FURNITURE AND A WALL

BACKGROUND OF THE INVENTION

The present invention relates to a device for immobilizing a piece of furniture. More particularly, the present invention relates to a wall contacting prevention device that is positioned on a floor and receives the right and left rear legs of a typical piece of furniture while maintaining the typical piece of furniture a predetermined distance from a wall.

Wall surfaces are frequently exposed to impact forces and other abuse from unintentional bumping by furniture that could slide. Furthermore, the presence of furniture positioned adjacent to a wall that has baseboard heating can cause a fire and blockage of the heat generated therefrom. An impact or scrapping force on a way may, for example, chip or dent or otherwise cause deterioration of a plaster wall.

Numerous innovations for wall protectors have been provided in the prior art that will be described. Even though these innovations may be suitable for the specific individual purposes to which they address, however, they differ from the present invention in that they do not teach to a wall contacting prevention device that is positioned on a floor and receives the right and left rear legs of a typical piece of furniture while maintaining the typical piece of furniture a predetermined distance from a wall.

FOR EXAMPLE, U.S. Pat. No. 3,869,106 to Gregov teaches a safety bumper for furniture that includes several molded or extruded shapes of a non-toxic, fire-retardant, resilient and flexible elastomeric plastic material such as elastomer, polyurethane, compounded rubber, and the like in a variety of colors. The shapes and colors thereof complement the shapes and colors of pieces of furniture.

ANOTHER EXAMPLE, U.S. Pat. No. 3,969,786 to Peak teaches a wall bumper that includes a resilient bumper which protrudes through an aperture in an annular retaining housing. The bumper has an enlarged annular base portion which abuts the interior front wall of the housing to maintain the bumper within the housing. A deformable plate is disposed within an annular channel in the wall of the housing and upon deformation maintains the bumper rigidly within the housing and provides means for securing the wall bumper to the wall.

STILL ANOTHER EXAMPLE, U.S. Pat. No. 4,161,853 to Weiss et al. teaches a wall protector that includes a retainer member adapted to be connected to a wall surface to be protected. A pair of spaced locking portions generally project outwardly from a wall portion of the retainer member. A resilient member configured to substantially cover the retaining member when mounted thereon is provided which has a pair of spaced engaging portions projecting towards the retainer member and adapted to snappingly engage the locking portions and maintain the retainer and resilient members spaced from each other at a predetermined distance.

FINALLY, YET ANOTHER EXAMPLE, U.S. Pat. No. 4,881,293 to Reynolds teaches a wedge member useable as a door stop on a carpeted floor that includes special triangular cross sectioned grooves that are formed in the lower face of the wedge member to bend and trap carpet pile yarns, whereby the wedge member is prevented from sliding out from beneath the door lower edge.

It is apparent that numerous innovations for wall protectors have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT of the present invention is to provide a device for preventing the unintentional contact between furniture and a wall that avoids the disadvantages of the prior art.

ANOTHER OBJECT of the present invention is to provide a device for preventing the unintentional contact between furniture and a wall that is simple and inexpensive to manufacture.

STILL ANOTHER OBJECT of the present invention is to provide a device for preventing the unintentional contact between furniture and a wall that is simple to use.

YET ANOTHER OBJECT of the present invention is to provide a device for preventing the unintentional contact between furniture and a wall that prevents wall surfaces from being exposed to impact forces and other abuse from unintentional bumping by furniture that could slide.

STILL YET ANOTHER OBJECT of the present invention is to provide a device for preventing the unintentional contact between furniture and a wall that prevents chips or dents or otherwise deterioration of a plaster wall caused by impact forces and other abuse from unintentional bumping by furniture that could slide.

YET STILL ANOTHER OBJECT of the present invention is to provide a device for preventing the unintentional contact between furniture and a wall that spaces furniture from the wall.

STILL YET ANOTHER OBJECT of the present invention is to provide a device for preventing the unintentional contact between furniture and a wall that will allow baseboard heat to radiate into a room as opposed to being absorbed by the furniture.

YET STILL ANOTHER OBJECT of the present invention is to provide a device for preventing the unintentional contact between furniture and a wall that maintains fire safety.

STILL YET ANOTHER OBJECT of the present invention is to provide a device for preventing the unintentional contact between furniture and a wall that improves heating efficiency.

YET STILL ANOTHER OBJECT of the present invention is to provide a device for preventing the unintentional contact between furniture and a wall that protects painted or wallpapered walls from being scarred or gouged by the furniture.

STILL YET ANOTHER OBJECT of the present invention is to provide a device for preventing the unintentional contact between furniture and a wall that protects the material of the furniture from being torn or otherwise damaged by contact with the wall.

YET STILL ANOTHER OBJECT of the present invention is to provide a device for preventing the unintentional contact between furniture and a wall that eliminates unwanted moving or shifting of the furniture and thereby prolonging the life thereof.

STILL YET ANOTHER OBJECT of the present invention is to provide a device for preventing the unintentional contact between furniture and a wall that is adaptable to all types of furniture including couches, easy chairs, love seats and the like.

BRIEFLY STATED, YET STILL ANOTHER OBJECT of the present invention is to provide a wall contacting prevention device that is positionable on a floor with a finish and receives right and left rear legs of a typical piece of furniture while maintaining the typical piece of furniture a predetermined distance from a wall that includes a right wall contacting prevention device and a left wall contacting prevention device.

STILL YET ANOTHER OBJECT of the present invention is to provide a device for preventing the unintentional contact between furniture and a wall wherein the right wall contacting prevention device has a longitudinal midpoint and is positionable on the floor, in abutment with the wall, and receives the right rear leg of the typical piece of furniture while maintaining the typical piece of furniture the predetermined distance from the wall.

YET STILL ANOTHER OBJECT of the present invention is to provide a device for preventing the unintentional contact between furniture and a wall wherein the left wall contacting prevention device has a longitudinal midpoint and is separate from the right wall contacting prevention device and positioned on the floor, in abutment with the wall, and receives the left rear leg of the typical piece of furniture while maintaining the typical piece of furniture the predetermined distance from the wall, so that heat from a baseboard heater, if present, radiates into a room as opposed to being absorbed by the typical piece of furniture, unintentional contact between the typical piece of furniture and the wall is prevented while maintaining fire safety, finished walls are protected from being damaged by contact with the typical piece of furniture, the typical piece of furniture is prevented from damage caused by contact with the wall, and unwanted moving of the typical piece of furniture is prevented and thereby prolonging the life thereof.

STILL YET ANOTHER OBJECT of the present invention is to provide a device for preventing the unintentional contact between furniture and a wall wherein each of the right wall contacting prevention device and the left wall contacting prevention device is made by appropriately cutting and bending a ⅛" steel plate.

YET STILL ANOTHER OBJECT of the present invention is to provide a device for preventing the unintentional contact between furniture and a wall wherein each of the right wall contacting prevention device and the left wall contacting prevention device is finished with a high heat enamel paint.

STILL YET ANOTHER OBJECT of the present invention is to provide a device for preventing the unintentional contact between furniture and a wall wherein each of the right wall contacting prevention device and the left wall contacting prevention device is made of molded plastic.

YET STILL ANOTHER OBJECT of the present invention is to provide a device for preventing the unintentional contact between furniture and a wall wherein each of the right wall contacting prevention device and the left wall contacting prevention device is selected from the group consisting of clear to allow the finish of the floor to show through and colored to match any color desired by a user.

STILL YET ANOTHER OBJECT of the present invention is to provide a device for preventing the unintentional contact between furniture and a wall wherein each of the right wall contacting prevention device and the left wall contacting prevention device has a flat and generally isosceles-trapezoid-shaped wall portion that has an elongated base with an outermost point, and a short side.

YET STILL ANOTHER OBJECT of the present invention is to provide a device for preventing the unintentional contact between furniture and a wall wherein each of the right wall contacting prevention device and the left wall contacting prevention device further has a flat and generally L-shaped extending portion that is integral, continuous, and co-planar with the flat and generally isosceles-trapezoid-shaped wall portion.

STILL YET ANOTHER OBJECT of the present invention is to provide a device for preventing the unintentional contact between furniture and a wall wherein the flat and generally L-shaped extending portion of each of the right wall contacting prevention device and the left wall contacting prevention device has an elongated and generally rectangular-shaped part with a distal end and a proximal end that is integral and continuous and co-planar with, and extends forwardly from, the short side of the flat and generally isosceles-trapezoid-shaped wall portion in a direction perpendicular to the elongated base of the flat and generally isosceles-trapezoid-shaped wall portion.

YET STILL ANOTHER OBJECT of the present invention is to provide a device for preventing the unintentional contact between furniture and a wall wherein the extending portion elongated and generally rectangular-shaped part of the flat and generally L-shaped extending portion of each of the right wall contacting prevention device and the left wall contacting prevention device has a generally circular-shaped throughbore that is positioned substantially at the longitudinal midpoint of the right wall contacting prevention device and is used for receiving a fastener for securing each of the right wall contacting prevention device and the left wall contacting prevention device to the floor.

STILL YET ANOTHER OBJECT of the present invention is to provide a device for preventing the unintentional contact between furniture and a wall wherein the flat and generally L-shaped extending portion of each of the right wall contacting prevention device and the left wall contacting prevention device further has a short and generally rectangular-shaped part that is shorter and integral and continuous and co-planar with, and has a proximal end that extends perpendicularly sidewardly outwardly from, the distal end of the elongated and generally rectangular-shaped part of the flat and generally L-shaped extending portion to a distance substantially in-line with the outermost point of the elongated base of the flat and generally isosceles-triangular-shaped wall portion, so that the flat and generally L-shaped extending portion of each of the right wall contacting prevention device and the left wall contacting prevention device allows the elongated and generally rectangular-shaped part of the flat and generally L-shaped extending portion of each of the right wall contacting prevention device and the left wall contacting prevention device to be positioned beneath the typical piece of furniture and since the outermost point of the elongated base of the flat and generally isosceles-trapezoid-shaped wall portion of each of the right wall contacting prevention device and the left wall contacting prevention device extends outwardly only to a distance substantially in-line with the short and generally rectangular-shaped part of the flat and generally L-shaped extending portion of each of the right wall contacting prevention device and the left wall contacting prevention device both the right wall contacting prevention device and the left wall contacting prevention device are substantially concealed and thereby do not interfere with placing one typical piece of furniture immediately adjacent to another typical piece of furniture.

YET STILL ANOTHER OBJECT of the present invention is to provide a device for preventing the unintentional contact between furniture and a wall wherein the short and generally rectangular-shaped part of the flat and generally L-shaped extending portion of the right wall contacting prevention device extends sidewardly outwardly in a direction opposite to that of the short and generally rectangular-shaped part of the left wall contacting prevention device.

STILL YET ANOTHER OBJECT of the present invention is to provide a device for preventing the unintentional contact between furniture and a wall wherein the short and generally rectangular-shaped part of the flat and generally L-shaped extending portion of each of the right wall contacting prevention device and the left wall contacting prevention device terminates in a straight free distal edge that has a length, is straight, and is substantially parallel to the elongated and generally rectangular-shaped part of the flat and generally L-shaped extending portion.

YET STILL ANOTHER OBJECT of the present invention is to provide a device for preventing the unintentional contact between furniture and a wall wherein the short and generally rectangular-shaped part of the flat and generally L-shaped extending portion of each of the right wall contacting prevention device and the left wall contacting prevention device further has a straight inner edge that has a length and is perpendicular and adjacent to the elongated and generally rectangular-shaped part of the flat and generally L-shaped extending portion and faces the flat and generally isosceles-trapezoid-shaped wall portion.

STILL YET ANOTHER OBJECT of the present invention is to provide a device for preventing the unintentional contact between furniture and a wall wherein the straight free distal edge of the short and generally rectangular-shaped part of the flat and generally L-shaped extending portion of each of the right wall contacting prevention device and the left wall contacting prevention device has a first generally rectangular-shaped and upwardly-extending tab that is integral and continuous with, and extends perpendicularly upwardly along the length of, the straight free distal edge of the generally rectangular-shaped part of the flat and generally L-shaped extending portion.

YET STILL ANOTHER OBJECT of the present invention is to provide a device for preventing the unintentional contact between furniture and a wall wherein the straight inner edge of the short and generally rectangular-shaped part of the flat and generally L-shaped extending portion of each of the right wall contacting prevention device and the left wall contacting prevention device has a second generally rectangular-shaped and upwardly-extending tab that is integral and continuous with, and extends perpendicularly upwardly along the length of, the straight inner edge of the short and generally rectangular-shaped part of the flat and generally L-shaped extending portion in a direction perpendicular to the first generally rectangular-shaped and upwardly-extending tab of the straight free distal edge of the short and generally rectangular-shaped part of the flat and generally L-shaped extending portion, so that any rearward force exerted on the second generally rectangular-shaped and upwardly-extending tab of the straight inner edge of the short and generally rectangular-shaped part of the flat and generally L-shaped extending portion by the typical piece of furniture is transmitted by way of the flat and generally L-shaped extending portion to the flat and generally isosceles-trapezoid-shaped wall portion where the elongated base of the flat and generally isosceles-trapezoid-shaped wall portion allows the rearward force to by evenly distributed along a wider area of the wall and prevents damage thereto while both the right wall contacting prevention device and the left wall contacting prevention device are prevented from lateral rocking.

STILL YET ANOTHER OBJECT of the present invention is to provide a device for preventing the unintentional contact between furniture and a wall wherein the first generally rectangular-shaped and upwardly-extending tab of the straight free distal edge of the short and generally rectangular-shaped part of the flat and generally L-shaped extending portion of each of the right wall contacting prevention device and the left wall contacting prevention device and a respective second generally rectangular-shaped and upwardly-extending tab of the straight inner edge of the short and generally rectangular-shaped part of the flat and generally L-shaped extending portion of each of the right wall contacting prevention device and the left wall contacting prevention device together with a respective short and generally rectangular-shaped part of each of the right wall contacting prevention device and the left wall contacting prevention device define a respective typical furniture leg right and left rear receptacle for receiving the right and rear legs of the typical piece of furniture.

YET STILL ANOTHER OBJECT of the present invention is to provide a method of using a wall contacting prevention device to maintain a typical piece of furniture a predetermined distance from a wall that includes the steps of positioning a right wall contacting prevention device on a floor where a right rear leg of a typical piece of furniture is to be positioned with an elongated base of a flat and generally isosceles-triangular-shaped wall portion of the right wall contacting prevention device abutting the wall and with a short and generally rectangular-shaped part of a flat and generally L-shaped extending portion of the right wall contacting prevention device facing sidewardly outwardly from an elongated and generally rectangular-shaped part of the flat and generally L-shaped extending portion, so that any rearward force exerted on a first generally rectangular-shaped and upwardly-extending tab of a straight inner edge of the short and generally rectangular-shaped part of the flat and generally L-shaped extending portion of the right wall contacting prevention device by the typical piece of furniture is transmitted by way of the flat and generally L-shaped extending portion of the right wall contacting prevention device to the flat and generally isosceles-trapezoid-shaped wall portion of the right wall contacting prevention device where the elongated base of the flat and generally isosceles-trapezoid-shaped wall portion of the right wall contacting prevention device allows the rearward force to by evenly distributed along a wider area of the wall and thereby preventing damage to the wall while the right wall contacting prevention device is prevented from lateral rocking, positioning a left wall contacting prevention device on the floor where a left rear leg of the typical piece of furniture is to be positioned with an elongated base of a flat and generally isosceles-trapezoid-shaped wall portion of the left wall contacting prevention device abutting the wall and with a short and generally rectangular-shaped part of a flat and generally L-shaped extending portion of the left wall contacting prevention device facing sidewardly outwardly from an elongated and generally rectangular-shaped part of the flat and generally L-shaped extending portion in a direction opposite to that of the short and generally rectangular-shaped part of the flat and generally L-shaped extending portion of the right wall contacting prevention device, so that any rearward force exerted on a first generally rectangular-shaped and upwardly-extending tab of a straight inner edge of the short and generally rectangular-shaped part of the flat and generally L-shaped extending portion of the left wall contacting prevention device by the typical piece of furniture is transmitted by way of the flat and generally L-shaped extending portion of the left wall contacting prevention device to the flat and generally isosceles-trapezoid-shaped wall portion of the left wall contacting prevention device where the elongated base of the flat and generally isosceles-trapezoid-shaped wall portion of the left wall contacting prevention device allows the rearward force to by evenly distributed along a wider area of the wall and thereby preventing damage to the wall while the left wall contacting prevention device is prevented from lateral rocking, positioning the right rear leg of the typical piece of furniture leg in a right rear leg receptacle of the right wall contacting prevention device, and positioning the left rear leg of the typical piece of furniture leg in a left rear leg receptacle of the left wall contacting prevention device, so that the typical piece of furniture is prevented from rearward movement as a result of the first generally rectangular-shaped and upwardly-extending tab of the straight inner edge of the short and generally rectangular-shaped part of the flat and generally L-shaped extending portion of each of the right wall contacting prevention device and the left wall contacting prevention device and the typical piece of furniture is prevented from sideward movement as a result of a second generally rectangular-shaped and upwardly-extending tab of a straight free distal edge of the short and generally rectangular-shaped part of the flat and generally L-shaped extending portion of each of the right wall contacting prevention device and the left wall contacting prevention device and thereby preventing the typical piece of furniture from unintentionally contacting the wall.

STILL YET ANOTHER OBJECT of the present invention is to provide a method of using a wall contacting prevention device that further includes the step of placing a fastener through a generally circular-shaped throughbore of the elongated and generally rectangular-shaped part of the flat and generally L-shaped extending portion of the right wall contacting prevention device for securing the right wall contacting prevention device to the floor.

YET STILL ANOTHER OBJECT of the present invention is to provide a method of using a wall contacting prevention device that further includes the step of placing a fastener through a generally circular-shaped throughbore of the elongated and generally rectangular-shaped part of the flat and generally L-shaped extending portion of the left wall contacting prevention device for securing the left wall contacting prevention device to the floor.

FINALLY, STILL YET ANOTHER OBJECT of the present invention is to provide a method of preventing the unintentional contact of a typical piece of furniture with a wall that includes the step of maintaining the typical piece of furniture a predetermined distance from the wall by a wall contacting prevention device that is positionable on a floor and receives right and left rear legs of a typical piece of furniture and which includes a right wall contacting prevention device that has a longitudinal midpoint and is positionable on the floor, in abutment with the wall, and receives the right rear leg of the typical piece of furniture while maintaining the typical piece of furniture the predetermined distance from the wall, and a left wall contacting prevention device that has a longitudinal midpoint and is separate from the right wall contacting prevention device and is positionable on the floor, in abutment with the wall, and receives the left rear leg of the typical piece of furniture while maintaining the typical piece of furniture the predetermined distance from the wall, so that heat from a baseboard heater, if present, radiates into a room as opposed to being absorbed by the typical piece of furniture, unintentional contact between the typical piece of furniture and the wall is prevented while maintaining fire safety, finished walls are protected from being damaged by contact with the typical piece of furniture, the typical piece of furniture is prevented from damage caused by contact with the wall, and unwanted moving of the typical piece of furniture is prevented and thereby prolonging the life thereof.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view illustrating the present invention in use with a typical piece of furniture;

FIG. 2 is an enlarged diagrammatic perspective view, with parts broken away, of the area in the dotted ellipse identified by arrow 2 in FIG. 1;

FIG. 3 is a diagrammatic top plan view taken in the direction of arrow 3 in FIG. 1;

FIG. 4 is a diagrammatic side elevational view taken in the direction of arrow 4 in FIGS. 1 and 3;

FIG. 5 is a diagrammatic top plan view of the pattern for the right embodiment of the present invention laid out flat before folding;

FIG. 6 is a diagrammatic top plan view of the pattern for the left embodiment of the present invention laid out flat before folding; and FIG. 7 is an enlarged diagrammatic side elevational view, with parts broken away, of the right embodiment of the present invention taken in the direction of arrow 7 in FIGS. 1–3 after folding with the left embodiment being a mirror image thereof.

LIST OF REFERENCE NUMERALS UTILIZED IN THE DRAWING

Right Embodiment

| | |
|---|---|
| 10 | right embodiment of the device for preventing the unintentional contact between furniture and a wall of the present invention |
| 12 | floor |
| 14 | wall |
| 16 | typical piece of furniture leg |
| 18 | typical piece of furniture |
| 20 | typical piece of furniture back |
| 22 | baseboard heater |
| 24 | room |
| 26 | flat and generally isosceles traperzoid-shaped wall portion |
| 28 | wall portion elongated base |
| 29 | wall portion base outermost point |
| 30 | wall portion short side |
| 32 | flat and generally L-shaped extending portion |
| 34 | extending portion elongated and generally rectangular-shaped part |
| 35 | extending portion elongated part generally circular-shaped throughbore |
| 36 | extending portion short and generally rectangular-shaped part |
| 38 | extending portion short part straight free distal edge |
| 40 | extending portion short part straight inner edge |
| 42 | extending portion short part straight free distal edge generally rectangular-shaped and upwardly-extending tab |

-continued

| LIST OF REFERENCE NUMERALS UTILIZED IN THE DRAWING | |
|---|---|
| 44 | extending portion short part straight inner edge generally rectangular-shaped and upwardly-extending tab |
| 46 | typical furniture leg right receptacle |
| | Left Embodiment |
| 110 | left embodiment of the device for preventing the unintentional contact between furniture and a wall of the present invention |
| 126 | flat and generally isosceles traperzoid-shaped wall portion |
| 128 | wall portion elongated base |
| 129 | wall portion base outermost point |
| 130 | wall portion short side |
| 132 | flat and generally L-shaped extending portion |
| 134 | extending portion elongated and generally rectangular-shaped part |
| 135 | extending portion elongated part generally circular-shaped throughbore |
| 136 | extending portion short and generally rectangular-shaped part |
| 138 | extending portion short part straight free distal edge |
| 140 | extending portion short part straight inner edge |
| 142 | extending portion short part straight free distal edge generally rectangular-shaped and upwardly-extending tab |
| 144 | extending portion short part straight inner edge generally rectangular-shaped and upwardly-extending tab |
| 146 | typical furniture leg left receptacle |

DETAILED DESCRIPTION OF THE PREFERRED EMBODIMENT

Referring now to the figures in which like numerals indicate like parts, and particularly to FIGS. 1–4, the right embodiment of the device for preventing the unintentional contact between furniture and a wall of the present invention is shown generally at 10 and the left embodiment of the device for preventing the unintentional contact between furniture and a wall of the present invention is shown generally at 110.

The right embodiment of the device for preventing the unintentional contact between furniture and a wall 10 and the left embodiment of the device for preventing the unintentional contact between furniture and a wall 110 are preferably made by milling and machining a two piece die (top and bottom), when installed in a hydraulic press, would cut and bend a ⅛" steel plate which would be finished with a high heat enamel paint.

The right embodiment of the device for preventing the unintentional contact between furniture and a wall 10 and the left embodiment of the device for preventing the unintentional contact between furniture and a wall 110 can also be preferably made by molding plastic which could be clear to allow the finish of the floor 12, whether carpeted or not to show through, or can be colored to match any color desired by a user.

The right embodiment of the device for preventing the unintentional contact between furniture and a wall 10 and the left embodiment of the device for preventing the unintentional contact between furniture and a wall 110 are positioned on a floor 12, abut against a wall 14, and receive a typical piece of furniture leg 16 of a typical piece of furniture 18 that has a typical piece of furniture back 20 that is maintained a predetermined distance from the wall 14, so that heat from a baseboard heater 22, if present, radiates into a room 24 as opposed to being absorbed by the typical piece of furniture 18 (see FIG. 4), unintentional contact between the typical piece of furniture 18 and the wall 14 is prevented while maintaining fire safety, painted or wallpapered walls 14 are protected from being scarred or gouged by the typical piece of furniture 18, the typical piece of furniture 18 is prevented from damage caused by contact with the wall 14, and unwanted moving or shifting of the typical piece of furniture 18 is prevented and thereby prolonging the life thereof.

The configuration of the right embodiment of the device for preventing the unintentional contact between furniture and a wall 10 can best be seen in FIGS. 5 and 7, and as such will be discussed with reference thereto.

The right embodiment of the device for preventing the unintentional contact between furniture and a wall 10 includes a flat and generally isosceles-trapezoid-shaped wall portion 26 that has a wall portion elongated base 28 with a wall portion base outermost point 29, and a wall portion short side 30.

The right embodiment of the device for preventing the unintentional contact between furniture and a wall 10 further includes a flat and generally L-shaped extending portion 32 that is integral, continuous, and co-planar with the flat and generally isosceles-trapezoid-shaped wall portion 26.

The flat and generally L-shaped extending portion 32 has an extending portion elongated and generally rectangular-shaped part 34 that has a proximal end that is integral and continuous and co-planar with, and extends forwardly from, the wall portion short side 30 of the flat and generally isosceles-trapezoid-shaped wall portion 26 in a direction perpendicular to the wall portion elongated base 28 of the flat and generally isosceles-trapezoid-shaped wall portion 26.

The extending portion elongated and generally rectangular-shaped part 34 of the flat and generally L-shaped extending portion 32 has an extending portion elongated part generally circular-shaped throughbore 35 that is positioned substantially at the longitudinal midpoint of the right embodiment of the device for preventing the unintentional contact between furniture and a wall 10 and is used for receiving a fastener, such as a nail or screw or the like for securing the right embodiment of the device for preventing the unintentional contact between furniture and a wall 10 to the floor 12.

The flat and generally L-shaped extending portion 32 further has an extending portion short and generally rectangular-shaped part 36 that is shorter and integral and continuous and co-planar with, and has a proximal end that extends perpendicularly sidewardly outwardly from, the distal end of the extending portion elongated and generally rectangular-shaped part 34 of the flat and generally L-shaped extending portion 32 to a distance substantially in-line with the wall portion base outermost point 29 of the wall portion elongated base 28 of the flat and generally isosceles-trapezoid-shaped wall portion 26.

The extending portion short and generally rectangular-shaped part 36 of the flat and generally L-shaped extending portion 32 terminates in an extending portion short part straight free distal edge 38 that is straight and substantially parallel to the extending portion elongated and generally rectangular-shaped part 34 of the flat and generally L-shaped extending portion 32.

The extending portion short and generally rectangular-shaped part 36 of the flat and generally L-shaped extending portion 32 further has an extending portion short part straight inner edge 40 that is perpendicular and adjacent to the extending portion elongated and generally rectangular-shaped part 34 of the flat and generally L-shaped extending portion 32 and faces the flat and generally isosceles-trapezoid-shaped wall portion 26.

The extending portion short part straight free distal edge 38 of the extending portion short and generally rectangular-shaped part 36 of the flat and generally L-shaped extending portion 32 has an extending portion short part straight free distal edge generally rectangular-shaped and upwardly-extending tab 42 that is integral and continuous with, and extends perpendicularly upwardly along the length of the extending portion short part straight free distal edge 38 of the extending portion short and generally rectangular-shaped part 36 of the flat and generally L-shaped extending portion 32.

The extending portion short part straight inner edge 40 of the extending portion short and generally rectangular-shaped part 36 of the flat and generally L-shaped extending portion 32 has an extending portion short part straight inner edge generally rectangular-shaped and upwardly-extending tab 44 that is integral and continuous with, and extends perpendicularly upwardly along the length of the extending portion short part straight inner edge 40 of the extending portion short and generally rectangular-shaped part 36 of the flat and generally L-shaped extending portion 32 in a direction perpendicular to the extending portion short part straight free distal edge generally rectangular-shaped and upwardly-extending tab 42 of the extending portion short part straight free distal edge 38 of the extending portion short and generally rectangular-shaped part 36 of the flat and generally L-shaped extending portion 32.

The extending portion short part straight free distal edge generally rectangular-shaped and upwardly-extending tab 42 of the extending portion short part straight free distal edge 38 of the extending portion short and generally rectangular-shaped part 36 of the flat and generally L-shaped extending portion 32 and the extending portion short part straight inner edge generally rectangular-shaped and upwardly-extending tab 44 of the extending portion short part straight inner edge 40 of the extending portion short and generally rectangular-shaped part 36 of the flat and generally L-shaped extending portion 32 together with the extending portion short and generally rectangular-shaped part 36 define a typical furniture leg right receptacle 46.

The configuration of the left embodiment of the device for preventing the unintentional contact between furniture and a wall 110 can best be seen in FIGS. 6, and as such will be discussed with reference thereto.

It is to be understood the left embodiment of the device for preventing the unintentional contact between furniture and a wall 110 is a mirror image of the right embodiment of the device for preventing the unintentional contact between furniture and a wall 10.

The left embodiment of the device for preventing the unintentional contact between furniture and a wall 110 includes a flat and generally isosceles-trapezoid-shaped wall portion 126 that has a wall portion elongated base 128 with a wall portion base outermost point 129, and a wall portion 130.

The left embodiment of the device for preventing the unintentional contact between furniture and a wall 110 further includes a flat and generally L-shaped extending portion 132 that is integral and continuous and co-planar with the flat and generally isosceles-trapezoid-shaped wall portion 126.

The flat and generally L-shaped extending portion 132 has an extending portion elongated and generally rectangular-shaped part 134 that has a proximal end that is integral and continuous and co-planar with, and extends forwardly from, the wall portion short side 130 of the flat and generally isosceles-trapezoid-shaped wall portion 126 in a direction perpendicular to the wall portion elongated base 128 of the flat and generally isosceles-trapezoid-shaped wall portion 126.

The extending portion elongated and generally rectangular-shaped part 134 of the flat and generally L-shaped extending portion 132 has an extending portion elongated part generally circular-shaped throughbore 135 that is positioned substantially at the longitudinal midpoint of the left embodiment of the device for preventing the unintentional contact between furniture and a wall 110 and is used for receiving a fastener, such as a nail or screw or the like for securing the left embodiment of the device for preventing the unintentional contact between furniture and a wall 10 to the floor 12.

The flat and generally L-shaped extending portion 132 further has an extending portion short and generally rectangular-shaped part 136 that is shorter and integral and continuous and co-planar with, and has a proximal end that extends perpendicularly sidewardly outwardly from, the distal end of the extending portion elongated and generally rectangular-shaped part 134 of the flat and generally L-shaped extending portion 132 to a distance substantially in-line with the wall portion base outermost point 129 of the wall portion elongated base 128 of the flat and generally isosceles-trapezoid-shaped wall portion 26, in a direction opposite to that in which the extending portion short and generally rectangular-shaped part 36 of the flat and generally L-shaped extending portion 32 extends.

The extending portion short and generally rectangular-shaped part 136 of the flat and generally L-shaped extending portion 132 terminates in an extending portion short part straight free distal edge 138 that is straight and substantially parallel to the extending portion elongated and generally rectangular-shaped part 134 of the flat and generally L-shaped extending portion 132.

The extending portion short and generally rectangular-shaped part 136 of the flat and generally L-shaped extending portion 132 further has an extending portion short part straight inner edge 140 that is perpendicular and adjacent to the extending portion elongated and generally rectangular-shaped part 134 of the flat and generally L-shaped extending portion 132 and faces the flat and generally isosceles-trapezoid-shaped wall portion 126.

The extending portion short part straight free distal edge 138 of the extending portion short and generally rectangular-shaped part 136 of the flat and generally L-shaped extending portion 132 has an extending portion short part straight free distal edge generally rectangular-shaped and upwardly-extending tab 142 that is integral and continuous with, and extends perpendicularly upwardly along the length of the extending portion short part straight free distal edge 138 of the flat and generally L-shaped extending portion 132.

The extending portion short part straight inner edge 140 of the extending portion short and generally rectangular-shaped part 136 of the flat and generally L-shaped extending portion 132 has an extending portion short part straight inner edge generally rectangular-shaped and upwardly-extending tab 144 that is integral and continuous with, and extends perpendicularly upwardly along the length of the extending portion short part straight inner edge 140 of the extending portion short and generally rectangular-shaped part 136 of the flat and generally L-shaped extending portion 132 in a direction perpendicular to the extending portion short part straight free distal edge generally rectangular-shaped and upwardly-extending tab 142 of the extending portion short part straight free distal edge 138 of the extending portion short and generally rectangular-shaped part 136 of the flat and generally L-shaped extending portion 132.

The extending portion short part straight free distal edge generally rectangular-shaped and upwardly-extending tab 142 of the extending portion short part straight free edge 138 of the extending portion short and generally rectangular-shaped part 36, 136 of the flat and generally L-shaped extending portion 132 and the extending portion short part straight inner edge generally rectangular-shaped and upwardly-extending tab 144 of the extending portion short part straight inner edge 140 of the extending portion short and generally rectangular-shaped part 136, 136 of the flat and generally L-shaped extending portion 132 together with the extending portion short and generally rectangular-shaped part 136 define a typical furniture leg left receptacle 146 (see FIG. 3).

As shown in FIG. 5, it is to be understood that when the right embodiment of the device for preventing the unintentional contact between furniture and a wall 10 and the left embodiment of the device for preventing the unintentional contact between furniture and a wall 110 is made by milling and machining metal, as discussed supra, the extending portion short part straight free distal edge generally rectangular-shaped and upwardly-extending tab 42, 142 of the extending portion short part straight free distal edge 38, 138 of the extending portion short and generally rectangular-shaped part 36 of the flat and generally L-shaped extending portion 32, 132 and the extending portion short part straight inner edge generally rectangular-shaped and upwardly-extending tab 44, 144 of the extending portion short part straight inner edge 40, 140 of the extending portion short and generally rectangular-shaped part 36, 136 of the flat and generally L-shaped extending portion 32, 132 are initially cut co-planar with the extending portion short and generally rectangular-shaped part 36, 136 of the flat and generally L-shaped extending portion 32, 132, and are subsequently bent perpendicularly upwardly therefrom, as shown in FIG. 7.

When the right embodiment of the device for preventing the unintentional contact between furniture and a wall 10, and equivalently the left embodiment of the device for preventing the unintentional contact between furniture and a wall 110 are made by molding plastic, as discussed supra, the extending portion short part straight free distal edge generally rectangular-shaped and upwardly-extending tab 42, 142 of the extending portion short part straight free distal edge 38, 138 of the extending portion short and generally rectangular-shaped part 36, 136 of the flat and generally L-shaped extending portion 32, 132 and the extending portion short part straight inner edge generally rectangular-shaped and upwardly-extending tab 44, 144 of the extending portion short part straight inner edge 40, 140 of the extending portion short and generally rectangular-shaped part 36, 136 of the flat and generally L-shaped extending portion 32, 132 are molded perpendicularly upwardly from the extending portion short and generally rectangular-shaped part 36, 136.

The manner of using the right embodiment of the device for preventing the unintentional contact between furniture and a wall 10 and the left embodiment of the device for preventing the unintentional contact between furniture and a wall 110, can best be seen in FIGS. 1–4, and as such will be discussed with reference thereto.

The right embodiment of the device for preventing the unintentional contact between furniture and a wall 10 is positioned on the floor 12 where the right rear leg of the typical piece of furniture leg 16 of the typical piece of furniture 18 is to be positioned, with the wall portion elongated base 28 of the flat and generally isosceles-trapezoid-shaped wall portion 26 abutting the wall 14 and with the extending portion short and generally rectangular-shaped part 36 of the flat and generally L-shaped extending portion 32 facing sidewardly outwardly from the extending portion elongated and generally rectangular-shaped part 34 of the flat and generally L-shaped extending portion 32.

If so desired, a fastener, such as a nail or screw or the like can be placed through the extending portion elongated part generally circular-shaped throughbore 35 of the extending portion elongated and generally rectangular-shaped part 34 of the flat and generally L-shaped extending portion 32 for securing the right embodiment of the device for preventing the unintentional contact between furniture and a wall 10 to the floor 12.

The left embodiment of the device for preventing the unintentional contact between furniture and a wall 110 is positioned on the floor 12 where the left rear leg of the right rear leg of the typical piece of furniture 18 is to be positioned, with the wall portion elongated base 128 of the flat and generally isosceles-trapezoid-shaped wall portion 126 abutting the wall 14 and with the extending portion short and generally rectangular-shaped part 136 of the flat and generally L-shaped extending portion 132 facing sidewardly outwardly from the extending portion elongated and generally rectangular-shaped part 134 of the flat and generally L-shaped extending portion 132 in a direction opposite to that of the extending portion short and generally rectangular-shaped part 36 of the flat and generally L-shaped extending portion 32.

If so desired, a fastener, such as a nail or screw or the like can be placed through the extending portion elongated part generally circular-shaped throughbore 135 of the extending portion elongated and generally rectangular-shaped part 134 of the flat and generally L-shaped extending portion 132 for securing the left embodiment of the device for preventing the unintentional contact between furniture and a wall 110 to the floor 12.

The right rear leg of the typical piece of furniture leg 16 of the typical piece of furniture 18 is positioned in the typical furniture leg right receptacle 46.

The left rear leg of the typical piece of furniture leg 16 of the typical piece of furniture 18 is positioned in the typical furniture leg left receptacle 146.

The typical piece of furniture 18 is prevented from rearward movement as a result of the extending portion short part straight inner edge generally rectangular-shaped and upwardly-extending tab 44, 144 of the extending portion short part straight inner edge 40, 140 of the extending portion short and generally rectangular-shaped part 36, 136 of the flat and generally L-shaped extending portion 32, 132.

The typical piece of furniture 18 is prevented from sideward movement as a result of the extending portion short part straight free distal edge generally rectangular-shaped and upwardly-extending tab 42, 142 of the extending portion short part straight free distal edge 38, 138 of the extending portion short and generally rectangular-shaped part 36, 136 of the flat and generally L-shaped extending portion 32, 132.

It is to be understood that the configurations of the right embodiment of the device for preventing the unintentional contact between furniture and a wall 10 and the left embodiment of the device for preventing the unintentional contact between furniture and a wall 110, discussed supra, is significant and of critical importance and must be considered in determining patentability. Support for this assertion can be found in In re Dailey et al., 149 U.S.P.Q. at 47 (CCPA 1976), where the Court held that the shape of a device must be considered in determining patentability, if the shape is significant:

"... the configuration of the container is a 'mere matter of choice' not significantly novel ...., [however,] ... Appellants have provided no argument which convinces us that the particularconfiguration of their container is significant ... "[Emphasis added]

The shape of the various components of the right embodiment of the device for preventing the unintentional contact between furniture and a wall 10 and the left embodiment of the device for preventing the unintentional contact between furniture and a wall 110 is significant for at least the reasons presented infra.

Any rearward force exerted on the extending portion short part straight inner edge generally rectangular-shaped and upwardly-extending tab 44, 144 of the extending portion short part straight inner edge 40, 140 of the extending portion short and generally rectangular-shaped part 36, 136 of the flat and generally L-shaped extending portion 32, 132 is transmitted by way of the flat and generally L-shaped extending portion 32, 132 to the flat and generally isosceles-trapezoid-shaped wall portion 26, 126 where the wall portion elongated base 28, 128 of the isosceles triangular shape of the flat and generally isosceles-trapezoid-shaped wall portion 26, 126 allows the rearward force to by evenly distributed along a wider area of the wall 14, so that no damage is done thereto while the right embodiment of the device for preventing the unintentional contact between furniture and a wall 10 and the left embodiment of the device for preventing the unintentional contact between furniture and a wall 110 are prevented from lateral rocking.

The L-shape of the flat and generally L-shaped extending portion 32, 132 allows the extending portion elongated and generally rectangular-shaped part 34, 134 of the flat and generally L-shaped extending portion 32, 132 to be positioned under the typical piece of furniture 18 and since the wall portion base outermost point 29, 129 of the wall portion elongated base 28, 128 of the flat and generally isosceles-trapezoid-shaped wall portion 26, 126 extends outwardly only to a distance substantially in-line with the extending portion short and generally rectangular-shaped part 36, 136 of the flat and generally L-shaped extending portion 32, 132, the right embodiment of the device for preventing the unintentional contact between furniture and a wall 10 and the left embodiment of the device for preventing the unintentional contact between furniture and a wall 110 are substantially concealed and thereby do not interfere with placing one typical piece of furniture 18 immediately adjacent to another typical piece of furniture 18.

It will be understood that each of the elements described above, or two or more together, may also find a useful application in other types of constructions differing from the types described above.

While the invention has been illustrated and described as embodied in a device for preventing the unintentional contact between furniture and a wall, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A device for maintaining a typical piece of furniture a predetermined distance from a wall, comprising:

a) a right wall contacting prevention device having a longitudinal midpoint and for positioning on a floor, in abutment with a wall, and for receiving the right rear leg of a typical piece of furniture, and for maintaining the typical piece of furniture a predetermined distance from the wall; and b) a left wall contacting prevention device having a longitudinal midpoint and being separate from said right wall contacting prevention device and for positioning on the floor, in abutment with the wall, and for receiving the left rear leg of the typical piece of furniture, and for maintaining the typical piece of furniture the predetermined distance from the wall, so that heat from a baseboard heater, if present, radiates into a room as opposed to being absorbed by the typical piece of furniture, unintentional contact between the typical piece of furniture and the wall is prevented while maintaining fire safety, finished walls are protected from being damaged by contact with the typical piece of furniture, the typical piece of furniture is prevented from damage caused by contact with the wall, and unwanted moving of the typical piece of furniture is prevented and thereby prolonging the life thereof; each of said right wall contacting prevention device and said left wall contacting prevention device having a flat and generally isosceles-trapezoid-shaped wall portion with an elongated base with an outermost point, and a short side; each of said right wall contacting prevention device and said left wall contacting prevention device further having a flat and generally L-shaped extending portion being integral, continuous, and co-planar with said flat and generally isosceles-trapezoid-shaped wall portion.

2. The device as defined in claim 1, wherein each of said right wall contacting prevention device and said left wall contacting prevention device is made by appropriately cutting and bending a ⅛" steel plate.

3. The device as defined in claim 2, wherein each of said right wall contacting prevention device and said left wall contacting prevention device is finished with a high heat enamel paint.

4. The device as defined in claim 1, wherein each of said right wall contacting prevention device and said left wall contacting prevention device is made of molded plastic.

5. The device as defined in claim 4, wherein each of said right wall contacting prevention device and said left wall contacting prevention device is a material selected from the group consisting of clear to allow the finish of the floor to show through and colored to match any color desired by a user.

6. The device as defined in claim 1, wherein said flat and generally L-shaped extending portion of each of said right wall contacting prevention device and said left wall contacting prevention device has an elongated and generally rectangular-shaped part with a distal end and a proximal end; said proximal end of said elongated and generally rectangular-shaped part is integral and continuous and co-planar with, and extends forwardly from, said short side of said flat and generally isosceles-trapezoid-shaped wall portion in a direction perpendicular to said elongated base of said flat and generally isosceles-trapezoid-shaped wall portion.

7. The device as defined in claim 6, wherein said elongated and generally rectangular-shaped part of said flat and generally L-shaped extending portion of each of said right wall contacting prevention device and said left wall contacting prevention device has a generally circular-shaped throughbore that is positioned substantially at said longitudinal midpoint of said right wall contacting prevention device and is used for receiving a fastener for securing each of said right wall contacting prevention device and said left wall contacting prevention device to the floor.

8. The device as defined in claim 6, wherein said flat and generally L-shaped extending portion of each of said right wall contacting prevention device and said left wall contacting prevention device further has a short and generally rectangular-shaped part that is shorter and integral and continuous and co-planar with, and has a proximal end that extends perpendicularly sidewardly outwardly from, said distal end of said elongated and generally rectangular-shaped part of said flat and generally L-shaped extending portion to a distance substantially in-line with said outermost point of said elongated base of said flat and generally isosceles-trapezoid-shaped wall portion, so that said flat and generally L-shaped extending portion of each of said right wall contacting prevention device and said left wall contacting prevention device allows said elongated and generally rectangular-shaped part of said flat and generally L-shaped extending portion of each of said right wall contacting prevention device and said left wall contacting prevention device to be positioned beneath the typical piece of furniture and since said outermost point of said elongated base of said flat and generally isosceles-trapezoid-shaped wall portion of each of said right wall contacting prevention device and said left wall contacting prevention device extends outwardly only to a distance substantially in-line with said short and generally rectangular-shaped part of said flat and generally L-shaped extending portion of each of said right wall contacting prevention device and said left wall contacting prevention device both said right wall contacting prevention device and said left wall contacting prevention device are substantially concealed and thereby do not interfere with placing one typical piece of furniture immediately adjacent to another typical piece of furniture.

9. The device as defined in claim 8, wherein said short and generally rectangular-shaped part of said flat and generally L-shaped extending portion of said right wall contacting prevention device extends sidewardly outwardly in a direction opposite to that of said short and generally rectangular-shaped part of said left wall contacting prevention device.

10. The device as defined in claim 9, wherein said short and generally rectangular-shaped part of said flat and generally L-shaped extending portion of each of said right wall contacting prevention device and said left wall contacting prevention device terminates in a straight free distal edge that has a length, is straight, and is substantially parallel to said elongated and generally rectangular-shaped part of said flat and generally L-shaped extending portion.

11. The device as defined in claim 10, wherein said short and generally rectangular-shaped part of said flat and generally L-shaped extending portion of each of said right wall contacting prevention device and said left wall contacting prevention device further has a straight inner edge that has a length and is perpendicular and adjacent to said elongated and generally rectangular-shaped part of said flat and generally L-shaped extending portion and faces said flat and generally isosceles-trapezoid-shaped wall portion.

12. The device as defined in claim 11, wherein said straight free distal edge of said short and generally rectangular-shaped part of said flat and generally L-shaped extending portion of each of said right wall contacting prevention device and said left wall contacting prevention device has a first generally rectangular-shaped and upwardly-extending tab that is integral and continuous with, and extends perpendicularly upwardly along said length of, said straight free distal edge of said generally rectangular-shaped part of said flat and generally L-shaped extending portion.

13. The device as defined in claim 12, wherein said straight inner edge of said short and generally rectangular-shaped part of said flat and generally L-shaped extending portion of each of said right wall contacting prevention device and said left wall contacting prevention device has a second generally rectangular-shaped and upwardly-extending tab that is integral and continuous with, and extends perpendicularly upwardly along said length of, said straight inner edge of said short and generally rectangular-shaped part of said flat and generally L-shaped extending portion in a direction perpendicular to said first generally rectangular-shaped and upwardly-extending tab of said straight free distal edge of said short and generally rectangular-shaped part of said flat and generally L-shaped extending portion, so that any rearward force exerted on said second generally rectangular-shaped and upwardly-extending tab of said straight inner edge of said short and generally rectangular-shaped part of said flat and generally L-shaped extending portion by the typical piece of furniture is transmitted by way of said flat and generally L-shaped extending portion to said flat and generally isosceles-trapezoid-shaped wall portion where said elongated base of said flat and generally isosceles-trapezoid-shaped wall portion allows the rearward force to by evenly distributed along a wider area of the wall and prevents damage thereto while both said right wall contacting prevention device and said left wall contacting prevention device are prevented from lateral rocking.

14. The device as defined in claim 13, wherein said first generally rectangular-shaped and upwardly-extending tab of said straight free distal edge of said short and generally rectangular-shaped part of said flat and generally L-shaped extending portion of each of said right wall contacting prevention device and said left wall contacting prevention device and a respective said second generally rectangular-shaped and upwardly-extending tab of said straight inner edge of said short and generally rectangular-shaped part of said flat and generally L-shaped extending portion of each of said right wall contacting prevention device and said left wall contacting prevention device together with a respective said short and generally rectangular-shaped part of each of said right wall contacting prevention device and said left wall contacting prevention device define a respective typical furniture leg right and left rear receptacle for receiving the right and rear legs of the typical piece of furniture.

15. A method of using a wall contacting prevention device to maintain a typical piece of furniture a predetermined distance from a wall, comprising the steps of:

a) positioning a right wall contacting prevention device on a floor where a right rear leg of a typical piece of furniture is to be positioned with an elongated base of a flat and generally isosceles-trapezoid-shaped wall portion of said right wall contacting prevention device abutting the wall and with a short and generally rectangular-shaped part of a flat and generally L-shaped extending portion of said right wall contacting prevention device facing sidewardly outwardly from an elongated and generally rectangular-shaped part of said flat and generally L-shaped extending portion of said right wall contacting prevention device, so that any rearward force exerted on a first generally rectangular-shaped and upwardly-extending tab of a straight inner edge of said short and generally rectangular-shaped part of said flat and generally L-shaped extending portion of said right wall contacting prevention device by the typical piece of furniture is transmitted by way of said flat and generally L-shaped extending portion to said flat and generally isosceles-trapezoid-shaped wall portion of said right wall contacting prevention device where said elongated base of said flat and generally isosceles-trapezoid-shaped wall portion of said right wall contacting prevention device allows the rearward force to by evenly distributed along a wider area of the wall and thereby preventing damage to the wall while said right wall contacting prevention device is prevented from lateral rocking;

b) positioning a left wall contacting prevention device on the floor where a left rear leg of the typical piece of furniture is to be positioned with an elongated base of a flat and generally isosceles-trapezoid-shaped wall portion of said left wall contacting prevention device abutting the wall and with a short and generally rectangular-shaped part of a flat and generally L-shaped extending portion of said left wall contacting prevention device facing sidewardly outwardly from an elongated and generally rectangular-shaped part of said flat and generally L-shaped extending portion of said left wall contacting prevention device in a direction opposite to that of said short and generally rectangular-shaped part of said flat and generally L-shaped extending portion of said right wall contacting prevention device, so that any rearward force exerted on a first generally rectangular-shaped and upwardly-extending tab of a straight inner edge of said short and generally rectangular-shaped part of said flat and generally L-shaped extending portion of said left wall contacting prevention device by the typical piece of furniture is transmitted by way of said flat and generally L-shaped extending portion to said flat and generally isosceles-trapezoid-shaped wall portion of said left wall contacting prevention device where said elongated base of said flat and generally isosceles-trapezoid-shaped wall portion of said left wall contacting prevention device allows the rearward force to by evenly distributed along a wider area of the wall and thereby preventing damage to the wall while said left wall contacting prevention device is prevented from lateral rocking;

c) positioning the right rear leg of the typical piece of furniture leg in a right rear leg receptacle of said right wall contacting prevention device wherein said right rear leg receptacle of said right wall contacting prevention device being formed by said first and second generally rectangular-shaped and upwardly-extending tabs of said right wall contacting prevention device; and d) positioning the left rear leg of the typical piece of furniture leg in a left rear leg receptacle of said left wall contacting prevention device wherein said left rear leg receptacle of said left wall contacting prevention device being formed by said first and second generally rectangular-shaped and upwardly-extending tabs of said left wall contacting prevention device, so that the typical piece of furniture is prevented from rearward movement as a result of said first generally and upwardly-extending tab of said straight inner edge of said short and generally rectangular-shaped part of said flat and generally L-shaped extending portion of each of said right wall contacting prevention device and said left wall contacting prevention device and the typical piece of furniture is prevented from sideward movement as a result of a second generally rectangular-shaped and upwardly-extending tab of a straight free distal edge of said short and generally rectangular-shaped part of said flat and generally L-shaped extending portion of each of said right wall contacting prevention device and said left wall contacting prevention device and thereby the typical piece of furniture is prevented from unintentionally contacting the wall.

16. The method as defined in claim 15; further comprising the step of placing a fastener through a generally circular-shaped throughbore of said elongated and generally rectangular-shaped part of said flat and generally L-shaped extending portion of said right wall contacting prevention device for securing said right wall contacting prevention device to the floor.

17. The method as defined in claim 15; further comprising the step of placing a fastener through a generally circular-shaped throughbore of said elongated and generally rectangular-shaped part of said flat and generally L-shaped extending portion of said left wall contacting prevention device for securing said left wall contacting prevention device to the floor.

* * * * *